US007708608B2

(12) United States Patent
Soh

(10) Patent No.: US 7,708,608 B2
(45) Date of Patent: May 4, 2010

(54) TERMINAL AND A METHOD FOR INSERTING THE TERMINAL INTO A COMPRESSION CONNECTOR HOUSING

(75) Inventor: Lip Teck Soh, Singapore (SG)

(73) Assignee: FCI, Versailles (FR)

( * ) Notice: Subject to any disclaimer, the term of this patent is extended or adjusted under 35 U.S.C. 154(b) by 55 days.

(21) Appl. No.: 11/992,241

(22) PCT Filed: Aug. 18, 2006

(86) PCT No.: PCT/SG2006/000238

§ 371 (c)(1),
(2), (4) Date: Mar. 17, 2008

(87) PCT Pub. No.: WO2007/037761

PCT Pub. Date: Apr. 5, 2007

(65) Prior Publication Data

US 2009/0137162 A1 May 28, 2009

(30) Foreign Application Priority Data

Sep. 28, 2005 (SG) ..... 200506289-8

(51) Int. Cl.
*H01R 4/50* (2006.01)

(52) U.S. Cl. ..... 439/862; 439/885

(58) Field of Classification Search ..... 439/83, 439/733.1, 862, 885
See application file for complete search history.

(56) References Cited

U.S. PATENT DOCUMENTS

| | | | | | |
|---|---|---|---|---|---|
| 4,996,766 | A * | 3/1991 | Piorunneck et al. | ..... | 29/842 |
| 5,259,769 | A | 11/1993 | Cruise et al. | ..... | 439/65 |
| 5,272,594 | A | 12/1993 | Delamoreaux | ..... | 361/736 |
| 5,358,413 | A | 10/1994 | Daly et al. | ..... | 439/79 |
| 5,848,920 | A * | 12/1998 | Klein et al. | ..... | 439/885 |
| 5,882,212 | A | 3/1999 | McHugh et al. | ..... | 439/74 |
| 5,919,064 | A * | 7/1999 | Petersen et al. | ..... | 439/637 |
| 6,139,377 | A * | 10/2000 | Chen | ..... | 439/885 |
| 6,485,338 | B1 | 11/2002 | Wu | ..... | 439/862 |
| 7,033,189 | B1 | 4/2006 | Zhang et al. | ..... | 439/135 |
| 7,306,494 | B2 * | 12/2007 | Soh | ..... | 439/862 |
| 7,357,665 | B1 * | 4/2008 | Yan | ..... | 439/500 |

FOREIGN PATENT DOCUMENTS

| | | |
|---|---|---|
| WO | WO 02/069453 A2 | 9/2002 |
| WO | WO 2006/057621 A1 | 6/2006 |

* cited by examiner

*Primary Examiner*—Thanh-Tam T Le
(74) *Attorney, Agent, or Firm*—Harrington & Smith

(57) ABSTRACT

A terminal for a compression connector, a terminal strip of interconnected terminals for compression connectors and a method for inserting a terminal into a compression connector housing. The terminal including a solder portion including an elongate main body extending along a first direction and a solder tail formed at one end of the main body and extending substantially perpendicular to said first direction; and a supporting member attached to the main body of the solder portion and extending substantially in said first direction.

6 Claims, 3 Drawing Sheets

TERMINAL AND A METHOD FOR INSERTING THE TERMINAL INTO A COMPRESSION CONNECTOR HOUSING

FIELD OF INVENTION

The present invention relates broadly to a terminal for a compression connector, a terminal strip of interconnected terminals for compression connectors and a method for inserting a terminal into a compression connector housing.

BACKGROUND

Typically, a compression connector comprises one or more terminals disposed in a connector housing. During assembly of the connector, the terminals are typically inserted into the prefabricated housing. For assembly purposes, the terminal typically has a carrier for handling the terminal. In one design, the carrier is attached to the terminal at a solder tail portion as an extension thereof. The solder tail portion and the carrier are typically disposed at one end of the terminal and extends substantially perpendicular to a main body of the terminal.

After the terminal is inserted into the housing, the carrier is cut away or broken off from the solder tail portion. The solder tail portion may be susceptible to damages in the process of removing the carrier, which may adversely effect the soldering of the solder tail portion to a board on which the connector is mounted.

In another terminal design, the carrier is attached to the terminal at a retention area of the terminal. The retention area is typically disposed at a midpoint along the height of the terminal. In this design, again the carrier is typically arranged substantially perpendicular to the main body of the terminal. The carrier will be cut away or broken off from the retention area after the terminal is inserted into the housing.

For the above-mentioned terminal designs, portions of the terminal are thus at a relatively long distance from a plane of the carrier, in particular when the carrier is attached to the solder tail portion. Those portions of the terminal are therefore susceptible to bending during handling and processing.

These problems are particularly significant when the height of the terminal is large in comparison to a width (or depth) of the terminal, such as tall terminals used to reduce deflection for preventing excessive wiping during compression and to meet a final connector height.

Therefore, there is a need to provide a terminal designed to address at least one of the above-mentioned problems.

SUMMARY

According to a first aspect of the present invention, there is provided a terminal for a compression connector, the terminal comprising a solder portion comprising an elongate main body extending along a first direction and a solder tail formed at one end of the main body and extending substantially perpendicular to said first direction; and a supporting member attached to the main body of the solder portion and extending substantially in said first direction.

A transverse width of the terminal may be substantially equal to or smaller than a longitudinal length of the main body of the solder portion.

The terminal may further comprise a substantially U-shaped resilient portion having two substantially parallel legs joined by a transverse base, with one of said leg of the U connected to the main body of the solder portion at an opposite end of the main body of the solder portion compared to the solder tail and extending substantially perpendicular to said first direction.

The resilient portion may comprise a retention barb formed on said one leg for securing the terminal in a connector housing.

The terminal may further comprise an extension portion formed at the opposite end of the main body of the solder portion compared to the solder tail and extending substantially perpendicular to said first direction for facilitating pushing of the terminal into a connector housing.

The support member may be releasably connected to the main body of the solder portion.

The support member may be connected to the main body of the solder portion via a break line.

The support member may comprise a stem portion connected to a base portion, wherein the stem portion is connected to the main body of the solder portion.

The base portion may be connected to another base portion of another terminal, forming a terminal strip.

According to a second aspect of the present invention, there is provided a terminal strip of interconnected terminals for compression connectors, each terminal comprising a solder portion comprising an elongate main body extending along a first direction and a solder tail formed at one end of the main body and extending substantially perpendicular to said first direction; and a supporting member attached to the main body of the solder portion and extending substantially in said first direction.

According to a third aspect of the present invention, there is provided a method for inserting a terminal into a compression connector housing, the terminal comprising a solder portion comprising an elongate main body extending along a first direction and a solder tail formed at one end of the main body and extending substantially perpendicular to said first direction, the method comprising aligning a supporting member attached to the main body of the solder portion and extending substantially in said first direction such that the first direction is substantially parallel to a side wall of the compression connector housing.

The method may further comprise pushing the terminal into the connector housing utilising an extension portion of the terminal formed at an opposite end of the main body of the solder portion compared to the solder tail and extending substantially perpendicular to said first direction.

The method may further comprise disconnecting the support member from the main body of the solder portion after insertion of the terminal into the connector housing.

The method may further comprise providing the terminals from a terminal strip of interconnected terminals.

BRIEF DESCRIPTION OF THE DRAWINGS

Embodiments of the invention will be better understood and readily apparent to one of ordinary skill in the art from the following written description, by way of example only, and in conjunction with the drawings, in which.

DETAILED DESCRIPTION

Figure 1:
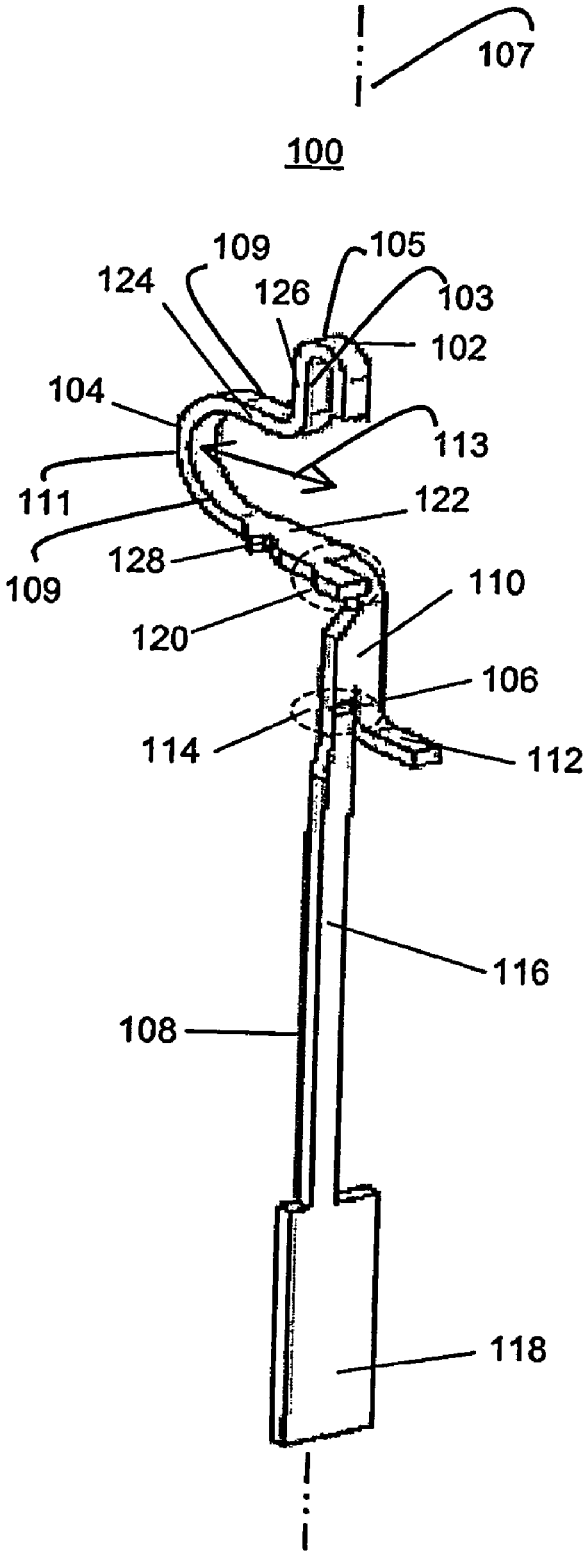
FIG. 1 shows a perspective view of a terminal in an example embodiment.

FIG. 1 shows a perspective view of a terminal 100 in an example embodiment. The terminal 100 has a longitudinal axis 107 and a substantially U-shaped contact portion 102, a substantially U-shaped mid portion 104, a solder portion 106 and a carrier portion 108. The contact portion has a pair of generally parallel legs 103 joined by a transverse base 105. The legs 103 extend generally parallel to the axis 107. The mid portion 104 has a pair of generally parallel legs 109 joined by a transverse base 111. The legs 109 extend generally perpendicular to the axis 107.

The solder portion 106 comprises an elongate main body 110 and a solder tail 112. The solder tail 112 is formed at one end of the main body 110 and extends substantially perpendicularly from the main body 110 in the example embodiment. The carrier portion 108 is attached to the main body 110 and extends substantially in the direction of the main body 110. The carrier portion 108 is releasably connected to the main body 110 via a break line 114.

It will be appreciated by a person skilled in the art that arranging the carrier portion 108 substantially parallel to the main body 110 allows the terminal 100 to be handled more easily during processing, as fewer portions of the terminal 100 may be relatively far away from a plane of the carrier portion 108. Thus, the terminal 100 advantageously is less susceptible to bending during handling. In the example embodiment, a dimension 113 of the terminal 100 perpendicular to the main body 110 of the solder portion 106 is substantially equal to or smaller than a length 115 of the main body 110. The dimension 113 is the transverse width from the contact portion 102 to the extremity of the portion 104.

The carrier portion 108 of the terminal 100 comprises a stem portion 116 connected to a base portion 118 in the example embodiment. The stem portion 116 is connected to the main body 110 of the solder portion 106. The base portion 118 of the terminal 100 is connected to another base portion 118 of another terminal 100, forming a terminal strip of terminals 100.

Figure 2:
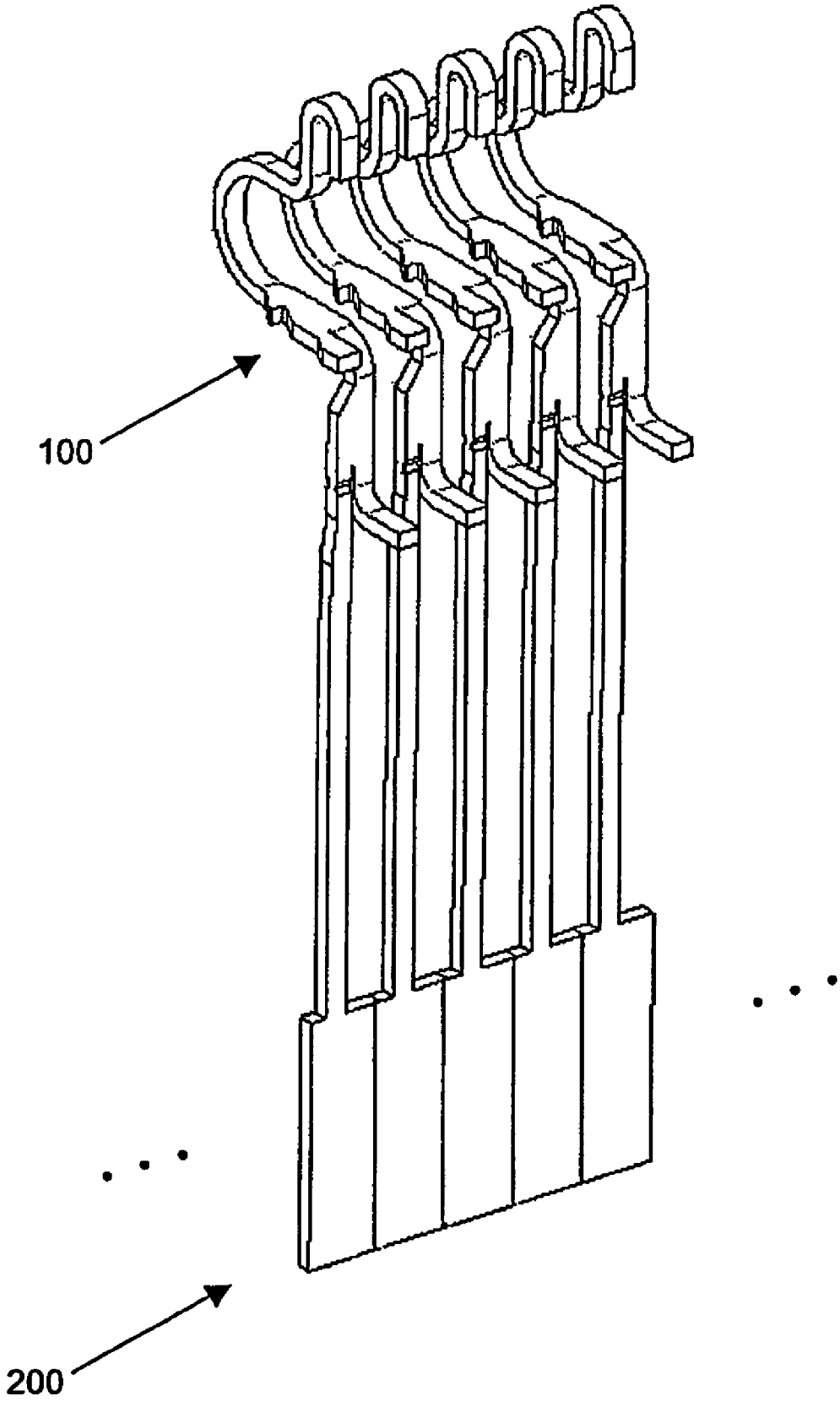
FIG. 2 shows a perspective view of a terminal strip of interconnected terminals in an example embodiment.

FIG. 2 shows a perspective view of a terminal strip 200 of interconnected terminals e.g. 100 in the example embodiment. The interconnected terminals e.g. 100 are arranged adjacent one another. A length of the terminal strip 200 can be wound around a reel (not shown) or a cartridge (not shown) for provision during production processes.

Referring back to FIG. 1, an extension portion 120 is formed at the opposite end of the main body 110 of the solder portion 106 compared to the solder tail 112. The extension portion 120 extends perpendicularly from the main body 110 in the example embodiment. The extension portion 120 facilitates pushing of the terminal 100 into the connector housing (not shown) in the example embodiment. Details of the assembling of the terminal 100 and the connector housing (not shown) will be described below with reference to FIG. 3.

At the opposite end of the main body 110 of the solder portion 106 compared to the solder tail 112, a leg 122 of the U-shaped mid portion 104 is connected to the main body 110. The leg 122 of the mid portion 104 extends substantially perpendicularly from the main body 110 in the opposite direction compared to the solder tail 112 in the example embodiment. A leg 124 of the mid portion 104 is connected to a leg 126 of the contact portion 102. The leg 124 of the mid portion 104 and 126 of the contact portion 102 are substantially perpendicular in the example embodiment.

The U-shaped mid portion 104 provides resilience to the contact portion 102 for accommodating compression when a Printed Circuit Board (PCB) (not shown) is pressed onto the contact portion 102. A retention barb 128 is formed on the leg 122 of the mid portion 104 in the example embodiment. The retention barb 128 secures the terminal 100 in a connector housing (not shown) after the terminal 100 is inserted into the connector housing (not shown).

Figure 3:
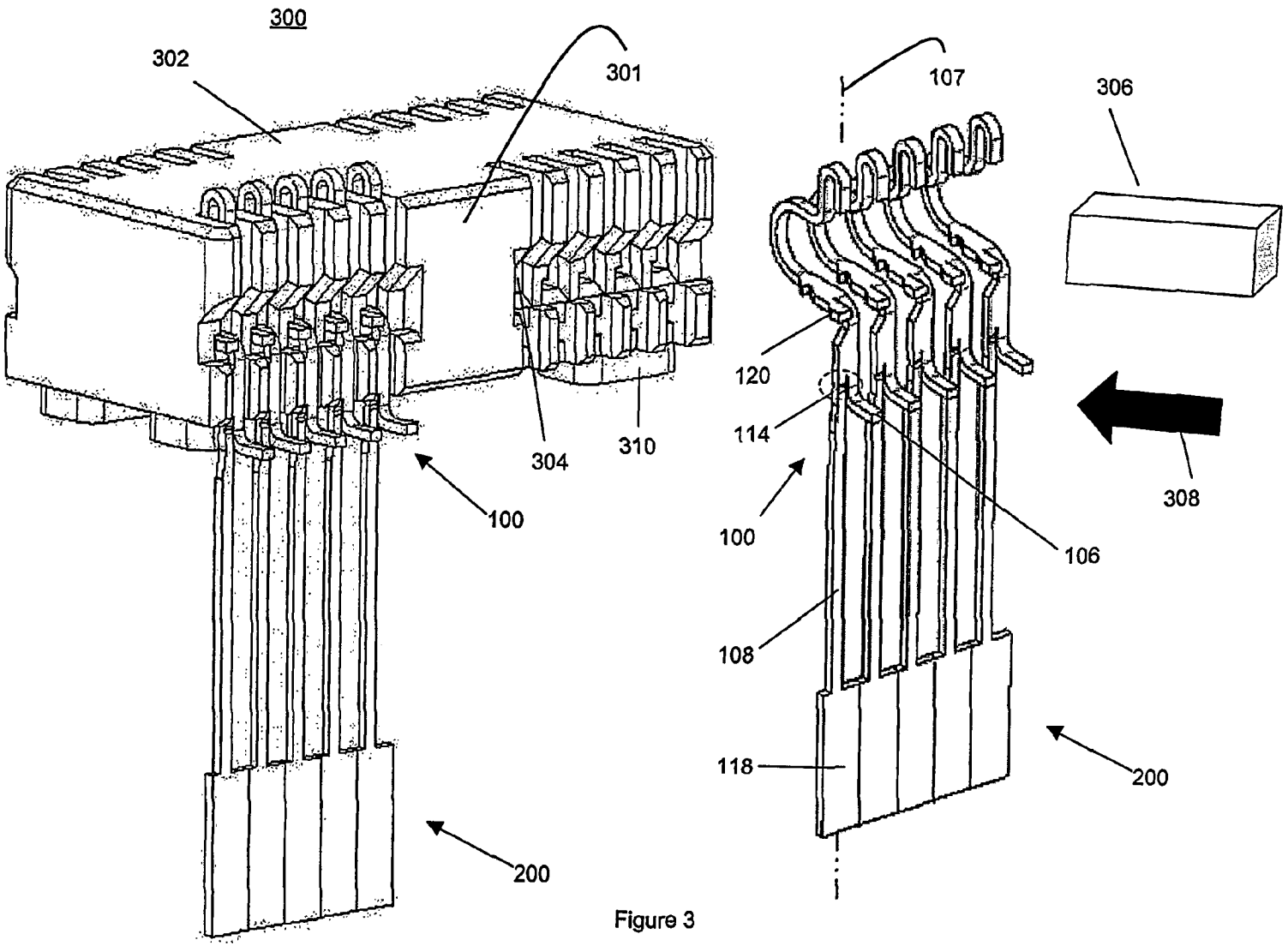
FIG. 3 shows a perspective view of a compression connector in an example embodiment.

FIG. 3 shows a perspective view of a compression connector 300 in the example embodiment. During assembly of the compression connector 300, a terminal strip 200 of the interconnected terminals e.g. 100 are held near a connector housing 302 and aligned in front of respective cavities 304 (shown in the right side of FIG. 3), with the longitudinal axis 107 substantially parallel to a side wall 301 of the connector housing 300. A block 306 is used to push the terminals 100 into the housing 302 in the direction 308. The block 306 presses against the extension portions 120 of each terminal 100 while the terminals 100 are pushed into the housing 302. The retention barbs (128 of FIG. 1) secure the terminals 100 in the housing 302 by engaging with sidewalls of the housing 302.

After the terminals are inserted into the housing 302, the carrier portions 108 are disconnected from the main body (110 of FIG. 1) of the solder portion 106. The carrier portions can be cut away or broken off from the main body 110 at the break line 114 in the example embodiment.

It can be seen that the cavities 304 are arranged in two rows along the housing 302. The two rows of cavities 304 are arranged adjacent one another in the example embodiment.

The housing 302 further comprises four rectangular protrusions 310 at the base of the housing 302. The protrusions 310 are utilised in mounting the connector 300 on the PCB (not shown) in the example embodiment.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

For example, the terminal may be made from conductive materials including, but not limited to, copper alloy, phosphor bronze, and/or gold or tin plated materials. Further, the terminal can be manufactured using known methods including but not limited to e.g. cutting and press forming.

Furthermore, the housing may be made of high temperature engineering plastic and other non-conductive materials such as, but not limited to, generic engineering plastics, e.g. Liquid Crystal Polymer (LCP). The housing can be manufactured using known methods including but not limited to e.g. casting and molding.

The shapes of the terminals and/or the housings are not limited to that shown in the example embodiments. Other shapes can be used in different embodiments, including differently shaped contact portions, mid portions, solder portions and carrier portions.

Further, it will be appreciated that the number of terminals per housing may be different in different embodiments.

The invention claimed is:

1. A terminal for a compression connector, the terminal comprising:

a solder portion comprising an elongate main body extending along a first direction and a solder tail extending substantially perpendicular to said first direction, wherein the solder tail is formed at a first end of the main body;

a supporting member attached to the main body and extending substantially in said first direction;

a substantially U-shaped resilient portion having two substantially parallel legs jointed by a transverse base, one of the two legs connected to the main body at a second end of the main body, opposite to the first end and extending substantially perpendicular to said first direction; and an extension portion formed at the second end of the main body and extending from said one of the two legs, wherein the extension portion is extended substantially perpendicular to said first direction for pushing of the terminal into a connector housing;

wherein the substantially U-shaped resilient portion comprises a retention barb formed on said one of the two legs for securing the terminal in the connector housing.

2. The terminal as claimed in claim 1, wherein a transverse width of the terminal is substantially equal to or smaller than a longitudinal length of the main body of the solder portion.

3. The terminal as claimed in claim 1, wherein the support member is releasably connected to the main body of the solder portion.

4. The terminal as claimed in claim 3, wherein the support member is connected to the main body of the solder portion via a break line.

5. The terminal as claimed in claim 1, wherein the support member comprises a stem portion connected to a base portion, wherein the stem portion is connected to the main body of the solder portion.

6. The terminal as claimed in claim 5, wherein the base portion is connected to another base portion of another terminal, forming a terminal strip.

* * * * *